US005698816A

United States Patent [19]

Roxby

[11] Patent Number: 5,698,816

[45] Date of Patent: Dec. 16, 1997

[54] IDENTIFIABLE BULLET AND METHOD FOR MANUFACTURING THE SAME

[75] Inventor: Donald L. Roxby, Huntsville, Ala.

[73] Assignee: Boeing North American, Inc., Seal Beach, Calif.

[21] Appl. No.: 660,218

[22] Filed: Jun. 3, 1996

[51] Int. Cl.[6] ..... F42B 12/00; B21R 21/06

[52] U.S. Cl. ..... 102/516; 102/439; 102/501; 29/1.23

[58] Field of Search ..... 102/293, 430, 102/439, 501, 506–510, 513–518; 29/1.2–1.23

[56] References Cited

U.S. PATENT DOCUMENTS

| | | | |
|---|---|---|---|
| 1,275,669 | 8/1918 | Forbes | 102/513 |
| 1,632,156 | 6/1927 | Wiley . | |
| 1,650,908 | 11/1927 | Ramsey . | |
| 1,887,324 | 11/1932 | Pocoroba . | |
| 2,592,434 | 4/1952 | Krasnow | 102/513 |
| 4,065,753 | 12/1977 | Paul, Jr. | 102/513 |
| 4,150,624 | 4/1979 | Hammond | 102/1 |
| 4,222,330 | 9/1980 | Krystyniak | 102/38 |
| 5,280,751 | 1/1994 | Muirhead et al. | 102/513 |
| 5,485,789 | 1/1996 | Collier | 102/501 |
| 5,511,483 | 4/1996 | Griffin, Jr. | 102/501 |

*Primary Examiner*—Harold J. Tudor
*Attorney, Agent, or Firm*—Harry B. Field; Lawrence N. Ginsberg

[57] ABSTRACT

The identifiable bullet includes a jacket having sidewalls and a rear base; a bullet core contained within the jacket, the bullet core comprising a rear end; and, an identification member positioned between the rear base and the rear end. The invention provides an inexpensive method to add identification members to bullets that will remain legible following cartridge discharge, bullet impact and post firing environments.

19 Claims, 4 Drawing Sheets

IDENTIFIABLE BULLET AND METHOD FOR MANUFACTURING THE SAME

BACKGROUND OF THE INVENTION

1. Field of the Invention

The present invention relates to identifiable bullets and, more particularly, to the placement of an identification member in the jacket of a bullet to provide identification.

2. Description of the Related Art

There are major debates in several countries concerning methods to reduce the number of crimes involving firearms. Many of these debates focus on more stringent penalties for persons using firearms during the commission of criminal acts and/or on tighter control on the sale of firearms. Statistics reflect that neither of these actions has significantly reduced crimes involving firearms. This is primarily because it is difficult to relate spent bullets to their users and because gun control has failed to reduce the number of guns in the possession of criminals. Recent research indicates that in the United States, the number of murders caused by firearms in increasing at a rate of three percent per year. This research indicates that there are more unsolved murders involving firearms now than at any time in the last three decades. Law enforcement officials currently relate spent bullets to the weapon that fired them by comparing the markings found on the bullet used in the commission of a crime against the markings found on other bullets fired from the same weapon. This can only be accomplished if the weapon is recovered and the bullet(s) used in the crime is found in relatively good condition. This information, however, is only useful if the weapon or ammunition used in the crime can then be related to the user.

U.S. Pat. No. 5,485,789, issued to W. E. Collier, discloses an identifiable bullet and method for identifying such bullets the bullet comprises a bullet jacket, a lead core and an identification tag in the lead core. The identification tag discussed in this patent is embedded in the lead core of the bullet during hot molding operations. This is accomplished by poring molten lead into a form to a desired level, stopping the flow to add the identification member and then completing the poring operation. This stop-and-go process requires the manufacturer to modify his excessing operations, slows manufacturing rates and, complicates the manufacturing process.

U.S. Pat. No. 1,632,156, issued to S. Wiley, discloses markings comprising bruised or embossed rings or ribs, the markings being knurled or smooth finished and positioned on the shell or cartridge. These markings are applied to provide an identification means which can be used to determine projectile type during handling operations. The marking method is considered to be too expensive for use in applications requiring lot or serialization. The method is also an ineffective for use in law enforcement applications because the markings can be altered prior to use and are badly damaged or obliterated during discharge and impact.

U.S. Pat. No. 1,887,324, issued to G. Pocoroba, discloses several different methods of embedding identification members (coiled metal strips) into bullets in a manner similar to that described in U.S. Pat. No. 5,485,789, above. It also describes the attachment of marking to the exterior of bullets using tags (metal clamps). These marking methods, while conducive to the application of lot or serial numbers, have not been adopted by industry because of cost considerations, the inability of the exterior markings to withstand the destructive forces of discharge and impact, and the adverse effects that the added identification members have on bullet trajectory (accuracy).

U.S. Pat. No. 4,222,330, issued to C. W. Krystyniak, discloses the use of magnetic articles disposed with a cartridge that exhibit a plurality of distinct Curie temperatures.

U.S. Pat. No. 1,650,908, issued to G. Ramsey, discloses the use of marked disks, which are blown out of the gun barrel at the time of discharge.

U.S. Pat. No. 4,150,624, issued to M. D. Hammond, discloses a method of bullet identification, which consists of the insertion of a metallic rod, marked with human readable markings, into a hole which has been drilled or molded into the base of the bullet. The patent also describes the placement of a square, marked steel insert into the bullet during the lead molding process.

As will be disclosed below, the present invention provides the ability to apply markings to bullets used in centerfire handgun ammunition that remain legible after firing and impact. The tamperproof markings can aid law enforcement agencies by providing a means to relate bullets to their manufacturer, seller and user.

SUMMARY OF THE INVENTION

The identifiable bullet of the present invention broadly comprises a jacket comprising sidewalls and a rear base; a bullet core contained within the jacket, the bullet core comprising a rear end; and, an identification member positioned between the rear base and the rear end. The invention provides an inexpensive method to add identification members to bullets that will remain legible following cartridge discharge, bullet impact and post firing environments.

The identifiable bullet is formed by securing a jacket in a desired position within a holding fixture. An identification member is placed over an opening in the jacket. The identification member is punched through the opening into a desired position against the rear base of the jacket. A bullet core is inserted and secured within the jacket so that the identification member is positioned between the rear base of the jacket and a rear end of the bullet core. The new identification insertion methods can be easily incorporated into today's high speed/high volume bullet manufacturing operations. The identification members utilized with the bullet marking system can be supplied by on-demand printing devices integrated into the assembly line are by a feed mechanism, which presents identification members printed or etched onto rolls or sheets. The identification members are punched into the jacket using a mechanical punch mechanism, which is synchronized with the flow of the identification members and bullet jackets. The system is superior to previously published systems in that it is simple, less expensive to install and operate and it can keep pace with current bullet production rates. It can be easily added to existing manufacturing lines and will not reduce (bottleneck) production rates.

The principles of the present invention can be used in both hot and cold form operations.

Other objects, advantages and novel features of the present invention will become apparent from the following detailed description of the invention when considered in conjunction with the accompanying drawings.

BRIEF DESCRIPTION OF THE DRAWINGS

The same elements or parts throughout the figures are designated by the same reference characters.

DETAILED DESCRIPTION OF THE PREFERRED EMBODIMENT

Figure 1:
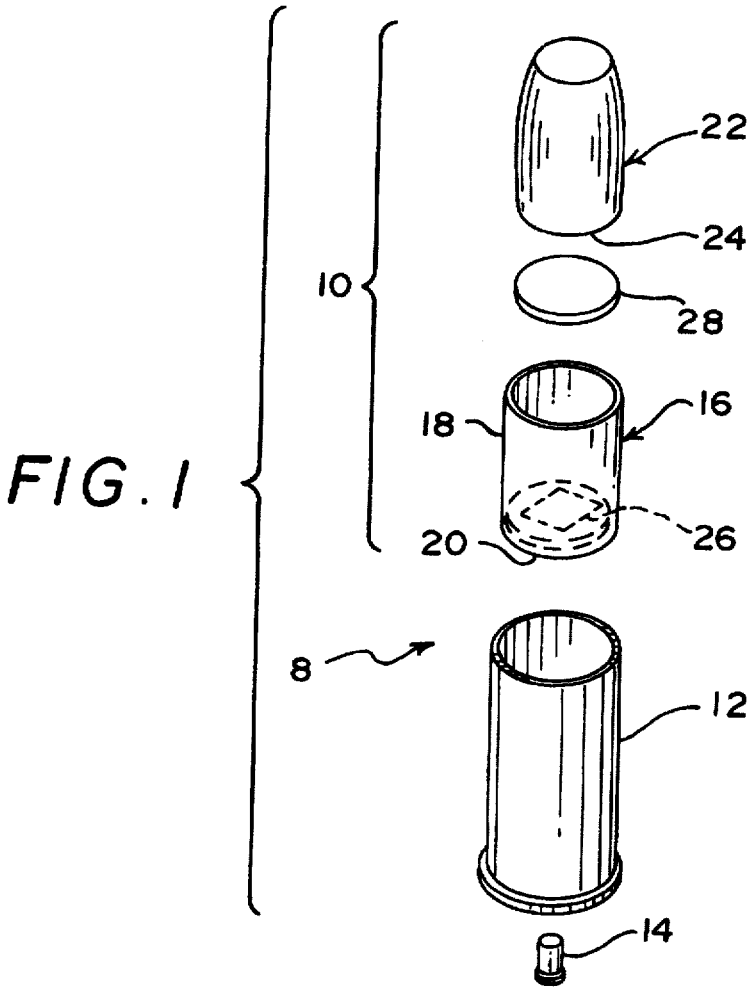
FIG. 1 is an exploded perspective view of a cartridge including the identifiable bullet of the present invention.

Referring now to the drawings and the characters of reference marked thereon, FIG. 1 illustrates an exploded perspective view of a cartridge, designated generally as 8, which includes an identifiable bullet 10, which is shown in accordance with principles of the present invention. The cartridge 8 includes a casing 12 for containing a powder charge. A primer 14 is used to detonate the powder charge.

The identifiable bullet 10 of the present invention includes a jacket, designated generally as 16, having sidewalls 18 and a rear base 20. The bullet 10 includes a bullet core 22 contained within the jacket 16, the bullet core including a rear end 24. An identification member 26 is positioned between the rear base 20 of the jacket 16 and the rear end 24 of the core 22. A protective insert 28 is preferably positioned between the identification member 26 and the bullet core 22 to protect any identification data on the identification member 26 therebetween.

The casing 12 and primer 14 of the cartridge are a conventional casing and primer. The jacket 16 and bullet core 22 are also conventional, in nature. The jacket is typically of a circular cross-section and formed of copper. The core 22 is typically formed of lead.

Figure 2:
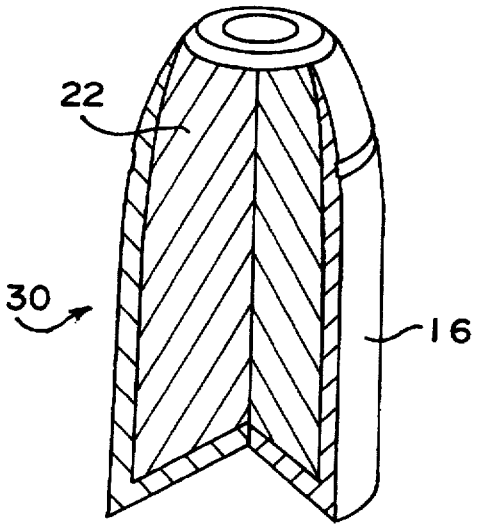
PRIOR ART FIG. 2
FIG. 2 (Prior Art) is a cutaway perspective view of a bullet without any identification component therein.
Figure 3:
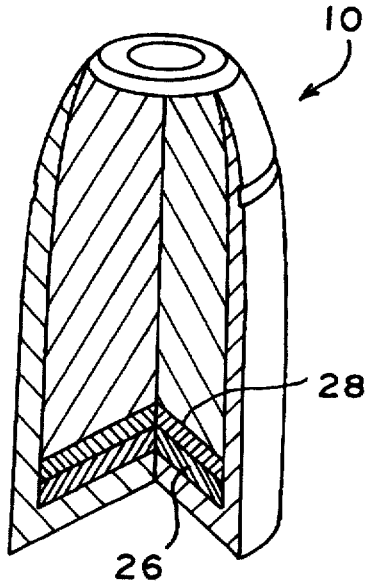
FIG. 3 is a cutaway perspective view of a bullet with an identification member and protective insert, in accordance with the principles of the present invention.

FIG. 2 (Prior Art) illustrates how the core 22 is placed within a jacket 16 of a conventional bullet, designated generally as 30. With the present invention, on the other hand, as can be seen perhaps most clearly seen in FIG. 3, the identification member 26 is placed in the rear of the bullet between the rear base 20 of the jacket and the rear end 24 of the core 22. The identification member 26 may comprise a metallic or non-metallic label bearing identification data. Examples of metallic materials which may be used are, for example, aluminum, copper, stainless steel, tin or metallic composites. The identification data may be provided by laser marking.

Examples of non-metallic labels include plastic, plastic composite, rubber or other elastomers. Similarly, such non-metallic labels may also be marked with a laser. The data may also be provided by simply printing the same on the metallic or non-metallic label.

Another example of an identification member may be, a fabric material label formed of, for example, cotton cloth, Nomex™ or Kelvar™. The information may be printed on the member or, for example, stitched or embroidered on the material.

Another example of an identification member is a paper label, which contains printed information.

The identification data may comprise a machine-readable matrix symbol or human readable information. The identification data may comprise color-coded information or other similarly suited coding methods.

As noted above, the FIG. 1 and 3 embodiment shows use of a protective insert 28. Such a protective insert is inserted between the identification member 26 and the bullet core 22 to protect any identification data on the identification member 26. Such a protective insert may be formed of aluminum, plastic, elastomers, or other resilient materials that can sufficiently protect the identification member 26.

Figure 4:
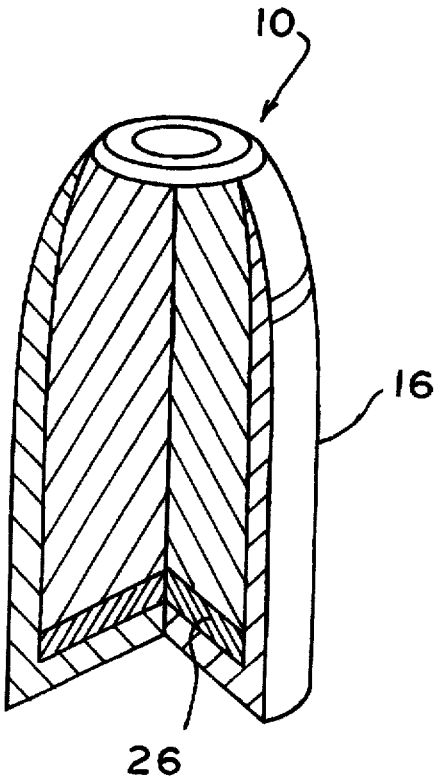
FIG. 4 is a cutaway perspective of a bullet with an identification member provided therein, without any protective insert.

Referring now to FIG. 4, it can be seen that use of the protective insert 28 may be optional. In FIG. 4, the protective insert is shown omitted. In such instance, the identification data would be located on the surface of the identification member 26, which is adjacent the rear base 20 instead of the back end 24 of the core 22.

Figure 5:
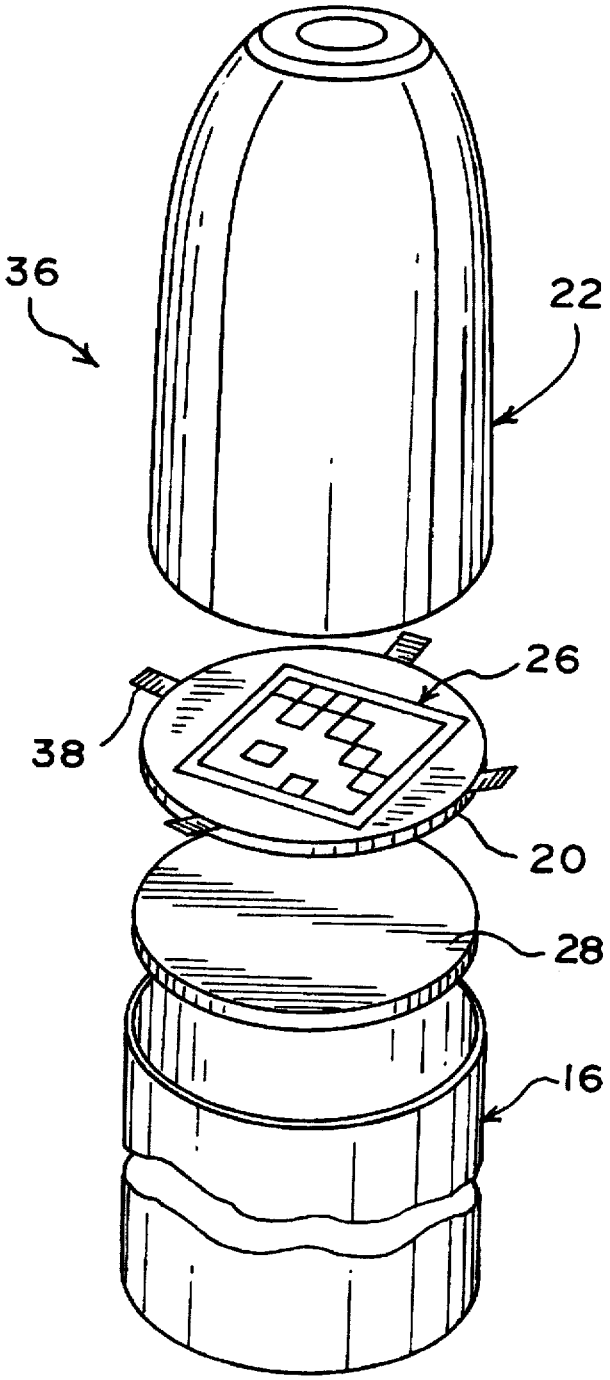
FIG. 5 is an exploded perspective view of another embodiment of the present invention having an identification member and protective insert, the protective insert being placed in a different position than the FIG. 3 embodiment.

Referring now to FIG. 5, another embodiment of the present invention is illustrated, designated generally as 36. In this embodiment, the protective insert 28 is positioned between the identification member 26 and the rear base 20 of the jacket 16. Positioning the protective insert 28 in this manner protects the identification data from the jacket 16 during discharge and impact. It is noted that during discharge and impact, the markings get pressed against the jacket. The protective insert protects against the damage caused by this compression.

FIG. 5 also illustrates that the identification member 26 preferably includes a plurality of spaced tabs 38 about its periphery. A first function of the tabs is that they facilitate the punching of the identification member 26 out of the sheet that it is typically printed on during manufacture. A clean punch is provided out of the base sheet. As will be explained below in more detail, the tabs 38 hold the identification member 26 in the jacket 16 prior to the insertion of the lead core 22.

Figure 6:
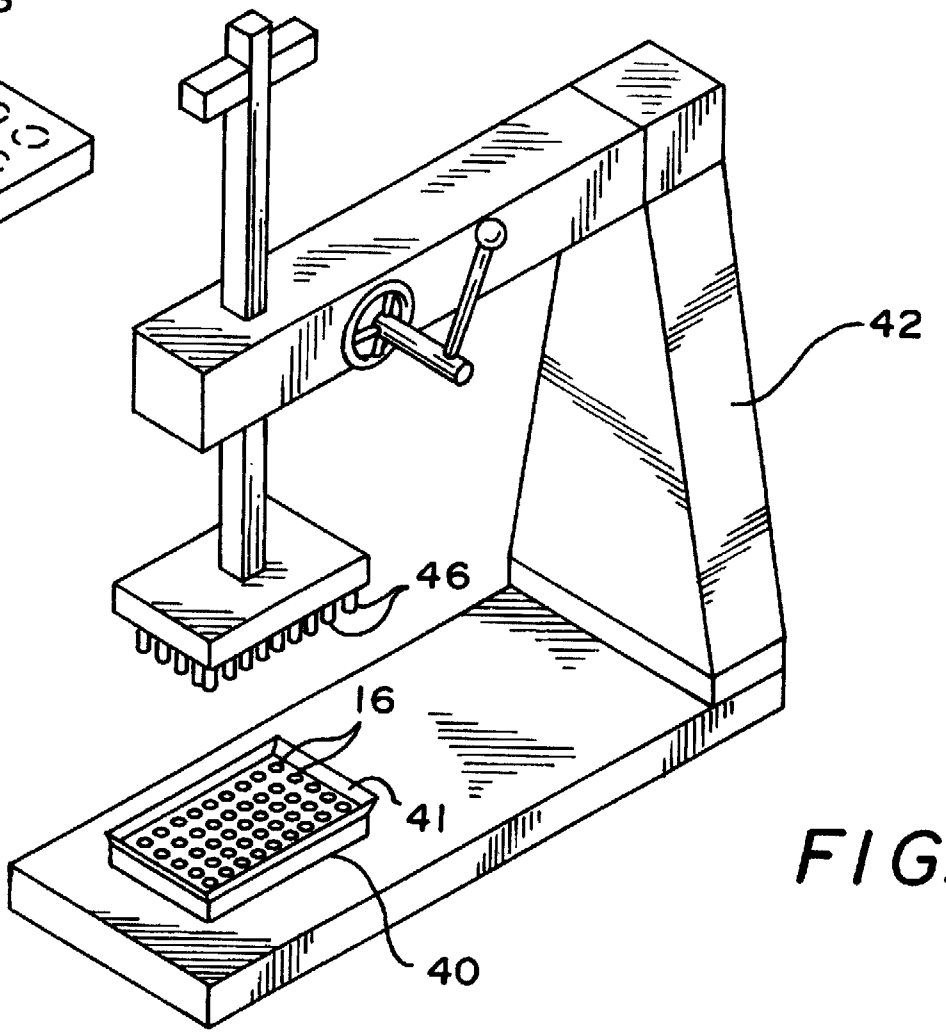
FIG. 6 is a perspective view of the use of a multi-headed manual punch for simultaneous manufacturing of a plurality of identifiable bullets.

Identifiable bullets in accordance with the principles of the present invention, can be manufactured easily and efficiently. Referring now to FIG. 6, a method for simultaneously manufacturing a plurality of identifiable bullets is illustrated. A holding fixture 40 is mounted on a multi-headed manual punch assembly 42. A number of jackets 16 are inserted bottom down into openings in the holding fixture 40. These jackets are required to be properly aligned with an identification sheet 44, which is on a surface of the holding fixture 40. Short alignment is maintained by side walls, tabs or other similar devices built onto the jacket alignment tray 41. Punches 46 are similarly aligned with the openings in the holding fixture 40. Thus, the identification members 26 on the identification sheet 44 are punched through the opening into their correct position against the rear base of the respective jacket 16 during operation of the punch. As noted above, with respect to FIG. 5, the identification members 26 preferably have tabs 38. These tabs 38 extend beyond the inside circumference of the jacket 16. Thus, when the identification member is punched into the jacket 16, they tend to hold the identification member 26 in its proper position. The bullet cores are then inserted and secured within the jackets of the identification members positioned between the rear base of the jacket and the rear end of the bullet core. The bullet cores are secured into the jackets by conventional methods, for example methods involving swage mechanisms. The diameter of the punch and the holding fixtures varies to accommodate the different caliber bullets being manufactured.

Figure 7:
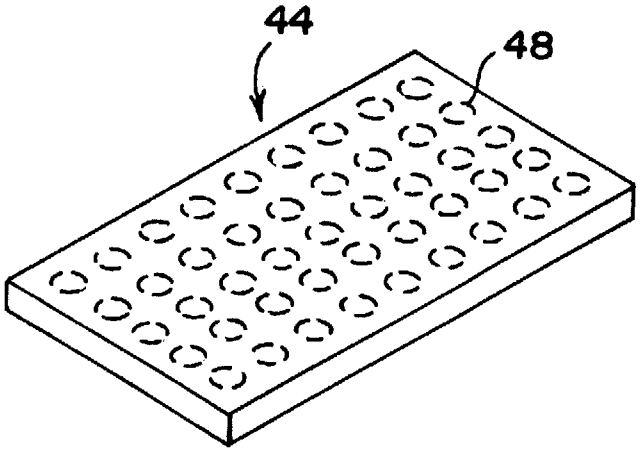
FIG. 7 is a perspective view of a pre-printed identification sheet containing a plurality of identification members.

Referring now to FIG. 7, an identification sheet 44 is illustrated. The sheet 44 contains a plurality of spaced circular perforations 48. The circular perforations 48 provide clean separation of each identification member from the sheet material from which is printed on. It is preferred that the identification member be formed with a circumference slightly larger than the inside diameter of the jacket 16. This helps to maintain the identification member in the jacket 16 firmly prior to insertion of the core 22. Alternatively, adhesive may be used to secure the identification member in place. Such a technique might, for example, involve the use of an adhesively backed sheet.

Figure 8:
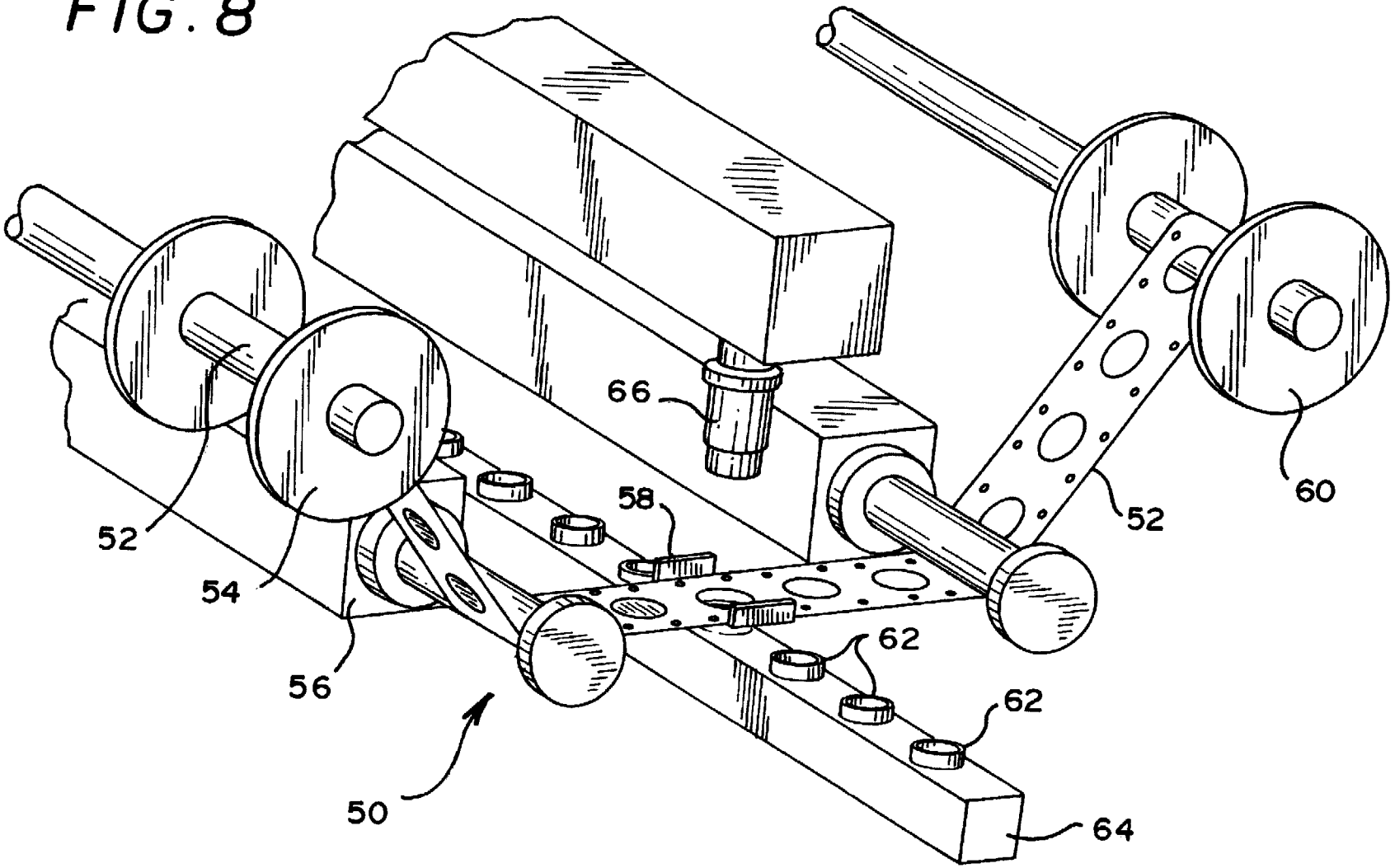
FIG. 8 is a perspective view of identification members being applied from a tape.

Referring now to FIG. 8, a perspective view of identification members being applied from tape is illustrated, designated generally as 50. A roll 52 of preprinted labels is provided on a supply reel 54. The supply reel 54 is mounted on a frame assembly 56. The tape 52 is fed through a combination holding and alignment fixture 58. It is then fed to a take up reel 60. Bullet jackets 62 are provided on a conveyor 64. Movement of the jackets 62 and the tape 52 is synchronized to arrive at the same position at the same time so that the identification members can be punched into their respective jackets properly. A punch 66 is mechanically driven down at a set speed and force. The punch heads 66 are interchangeable to accommodate different caliber jackets 62.

The present invention provides the capability for a forensic specialist to dissect the spent bullet and obtain the identification member. By reading the code, the spent bullet can be traced back to the person who purchased the ammunition.

Obviously, many modifications and variations of the present invention are possible in light of the above teachings. For example, although the present invention has been described with the use of a multi-bullet insertion device 42, it is understood that single bullet insertion devices and/or various types of feed mechanisms may be used. These might include the use of high pressure gas in-lieu of a mechanical punch to force the identification member into the bullet jacket or the use of a electro-magnet to draw the identification member into position in the jacket. It is therefore to be understood that, within the scope of the appended claims, the invention may be practiced otherwise than as specifically described.

What is claimed and desired to be secured by Letters Patent of the United States is:

1. An identifiable bullet, comprising:

a jacket comprising sidewalls and a rear base;

a bullet core contained within said jacket, said bullet core comprising a rear end; and an identification member positioned between said rear base and said rear end.

2. The identifiable bullet of claim 1, wherein said jacket and said bullet core each have a circular cross-section and said identification member comprises a thin disk marked with identification data.

3. The identifiable bullet of claim 1, further including adhesive material applied between said identification member and said jacket for affixing said identification member to said jacket during fabrication to prevent undesired movement of said identification member prior to containment of said bullet within said jacket.

4. The identifiable bullet of claim 1, wherein said identification member is initially slightly wider than said jacket so that it is pressed into position within said jacket and secured therein during fabrication of said bullet to prevent undesired movement of said identification member prior to containment of said bullet core within said jacket.

5. The identifiable bullet of claim 1, further including a protective insert, which is inserted between said identification member and said bullet core to protect any identification data on said identification member therebetween.

6. The identifiable bullet of claim 1, further including a protective insert, which is inserted between said identification member and said jacket to protect any identification data on said identification member therebetween.

7. The identifiable bullet of claim 1, wherein said identification member comprises a metallic label.

8. The identification bullet of claim 1, wherein said identification member comprises a label, which has been marked with a laser.

9. The identification bullet of claim 1, wherein said identification member comprises a non-metallic label, which has been marked with a laser.

10. The identification bullet of claim 1, wherein said identification member comprises a fabric material label, which contains printed information.

11. The identification bullet of claim 1, wherein said identification member comprises a fabric material label, which contains information which has been stitched or embroidered onto the material.

12. The identification bullet of claim 1, wherein said identification member comprises a paper label, which contains printed information.

13. The identification bullet of claim 1, wherein said identification member comprises tabs to facilitate punching.

14. The identifiable bullet of claim 1, wherein said identification member comprises identification data comprising a machine-readable matrix symbol.

15. The identifiable bullet of claim 1, wherein said identification member comprises identification data comprising human readable information.

16. A method for making an identifiable bullet, comprising:

securing a jacket having side walls and a rear base in a desired position within a holding fixture;

placing an identification member over an opening in said jacket;

punching the identification member through said opening into a desired position against a said rear base of said jacket; and inserting and securing a bullet core within said jacket so that the identification member is positioned between the rear base of the jacket and a rear end of the bullet core.

17. The method of claim 16, wherein a protective insert is inserted into said jacket adjacent to said identification member prior to insertion of said bullet core.

18. The method of claim 16, wherein said identification member comprises tape including tabs to facilitate punching.

19. The method of claim 16, wherein said identification member comprises perforations for facilitating punching.

* * * * *